US005230205A

United States Patent [19]

Hautemont

[11] Patent Number: 5,230,205

[45] Date of Patent: Jul. 27, 1993

[54] METHOD AND APPARATUS FOR POSITIONING A STRIP OF TOPS ON A SET OF RECEPTACLES, PRIOR TO SEALING

[75] Inventor: Jean-Claude Hautemont, Gif sur Yvette, France

[73] Assignee: Erca S.A., France

[21] Appl. No.: 800,954

[22] Filed: Dec. 2, 1991

[30] Foreign Application Priority Data

Dec. 3, 1990 [FR] France ..... 90 15130

[51] Int. Cl.[5] ..... B65B 7/28

[52] U.S. Cl. ..... 53/485; 53/478; 53/51; 53/329.3; 156/69; 156/361

[58] Field of Search ..... 156/69, 361, 552; 53/51, 290, 329.2, 329.3, 478, 485, 487, 389.2

[56] References Cited

U.S. PATENT DOCUMENTS

| | | | |
|---|---|---|---|
| 3,238,691 | 3/1966 | Miller et al. | 53/51 |
| 3,294,301 | 12/1966 | Richter | 53/51 |
| 3,374,602 | 3/1968 | Hamilton | 53/51 |
| 3,555,768 | 1/1971 | Miller | 53/485 X |
| 3,628,301 | 12/1971 | Vermeulen | 53/329.3 X |
| 3,652,363 | 3/1972 | Kinslow | 156/361 |
| 3,762,125 | 10/1973 | Prena | 53/51 |
| 3,861,983 | 1/1975 | Harrell | 53/51 X |
| 4,018,028 | 4/1977 | Donnet | 53/51 |

FOREIGN PATENT DOCUMENTS 1330729 5/1963 France .

*Primary Examiner*—John Sipos
*Assistant Examiner*—Daniel Moon
*Attorney, Agent, or Firm*—Blakely, Sokoloff, Taylor & Zafman

[57] ABSTRACT

A method of positioning a continuous strip of tops over a continuous set of receptacles prior to sealing, wherein the following steps are performed repeatedly;

the set of receptacles is advanced past sealing means through a distance equal to one longitudinal pitch of the receptacles or a multiple thereof;

simultaneously, the strip of tops is released over a length equal to one longitudinal pitch of the tops or a multiple of said pitch, with said strip being driven by the set of receptacles, and with the longitudinal pitch of the tops being slightly greater than the longitudinal pitch of the receptacles; and applying deformation to a central zone of each top level with the sealing means so as to shift the edges between the not-yet sealed tops so that they overlie the corresponding edges between receptacles.

10 Claims, 2 Drawing Sheets

METHOD AND APPARATUS FOR POSITIONING A STRIP OF TOPS ON A SET OF RECEPTACLES, PRIOR TO SEALING

The present invention relates in general to installing flexible tops or lids on flanged receptacles. It relates more particularly to a novel method of feeding and fixing a strip comprising a plurality of tops onto a set of receptacles.

BACKGROUND OF THE INVENTION

In the prior art, plastic parts are thermoformed continuously in groups over a width that may be quite large, e.g. as much as one meter.

Conventionally, the receptacles are filled, and then a printed flexible strip having the same width is fed continuously onto the set of receptacles and is then sealed to the flanges by an appropriate electrode or heating tool, thereby putting tops onto the receptacles. It is only after this has been done that a cutting tool is used to separate the receptacles either individually or else in groups of one or more rows (e.g. 2, 4, 6, 8, . . . ).

Naturally, while feeding a single flexible strip of tops that is preprinted, it is essential for each top to be accurately positioned relative to its receptacle. Thus, even a small amount of slip must be avoided since it will end up by accumulating and giving rise to perceptible offsets between the receptacles and the printing formed on their tops, with the printing being conventionally designed so that a well-determined print zone corresponds as accurately as possible with a receptacle.

A known solution to this problem consists in using a strip of tops at a longitudinal pitch that is slightly smaller than the longitudinal pitch of the receptacles, and in stretching the strip in the longitudinal direction and in controlled manner, to compensate for the difference in pitch. Document FR-A-1 330 729 describes a solution of that type. For tops made of materials suitable for permanent elongation, stretching is performed during a short predetermined time prior to sealing the strip onto the flanges, and this presents no particular difficulties.

However, some materials for tops, in particular composites of paper and plastic (particularly polyester) or paper and aluminum are difficult to stretch and to position since they can be lengthened to a limited extent only.

As a result, the strip must be kept under a high degree of tension throughout the process which means that forces which may give rise to failure are applied to the machine as a whole, in particular between the strip advance mechanism and the pot advance mechanism. More precisely, because of phenomena of uncontrolled slipping, wear, or jamming, it often happens that unwanted offsets arise firstly between the receptacles and the tops, and secondly between the receptacles and the heating tool for welding on the tops, or between the receptacles and the cutting tool, which naturally spoils the look of the receptacles and may even cause the strip of receptacles to rupture.

Another known solution consists in using a strip of tops having a longitudinal pitch that is slightly longer than the longitudinal pitch of the receptacles and in locally folding or wrinkling the strip of tops in order to take up the slack. Such folding or wrinkling is generally performed at the transition between two receptacles. This solution is disadvantageous, particularly with respect to appearance, especially when the receptacles are to remain in groups. Moreover, it is necessary in most cases to provide a receptacle of a special shape. Abovementioned patent FR-A-1 330 729 teaches a solution of this type, as do U.S. Pat. Nos. 3,238,691 and 3,861,983.

The present invention seeks to mitigate these drawbacks of the prior art and to provide a method and an apparatus for placing a strip of tops on a set of receptacles in a manner that makes it possible to achieve and conserve accurate mutual positioning between the various mechanisms and tools, while avoiding exerting large forces and while avoiding the formation of folds or wrinkles in the tops, with this being done while using a strip of tops whose longitudinal pitch is slightly greater than the longitudinal pitch of the receptacles.

The invention relates in particular to improved means for re-establishing correspondence between the pitches prior to welding.

SUMMARY OF THE INVENTION

To this end, in a first aspect, the present invention provides a method of positioning a continuous strip of tops over a continuous set of receptacles prior to sealing, wherein the following steps are performed repeatedly;

the set of receptacles is advanced past sealing means through a distance equal to one longitudinal pitch of the receptacles or a multiple thereof;

simultaneously, the strip of tops is released over a length equal to one longitudinal pitch of the tops or a multiple of said pitch, with said strip being driven by the set of receptacles, and with the longitudinal pitch of the tops being slightly greater than the longitudinal pitch of the receptacles; and applying deformation to a central zone of each top level with the sealing means so as to shift the edges between the not-yet sealed tops so that they overlie the corresponding edges between receptacles.

It has been observed, unexpectedly, that by implementing the above method, although the deformation is applied centrally to each top, the pitch of the strip of tops is properly realigned with the pitch of the receptacles, even in the side edge regions of the receptacles and of the strip of tops.

In another aspect, the invention provides an apparatus for positioning a continuous strip of tops over a continuous set of receptacles prior to sealing, wherein the apparatus comprises:

a receptacle-advance mechanism for advancing a set of receptacles past selaing means through a distance equal to one longitudinal pitch of the receptacles or a multiple thereof;

a strip-advance mechanism for advancing the strip of tops to release a length of said strip equal to one longitudinal pitch of the tops or a multiple thereof, said strip being entrained by the advance of the set of receptacles, and said longitudinal pitch of the tops being slightly greater than the longitudinal pitch of the receptacles;

deformation means provided in the sealing means to exert deformation on the central zones of the tops that are to be sealed; and regulation means for regulating the amplitude of the deformation so as to shift the edges between not-yet sealed tops so as to cause them to overlie the corresponding edges between receptacles.

BRIEF DESCRIPTION OF THE DRAWINGS

An embodiment of the invention is described by way of example with reference to the accompanying drawings, in which.

DETAILED DESCRIPTION

With reference to the drawings, reference 10 designates a roll of a strip or film 12 of tops, e.g. made of a paper-and-polyethylene or a polyethylene-and-aluminum composite and printed in conventional manner on one of its faces so as to define individual top patterns 12*a* over a width corresponding to a given number of receptacles.

Figure 1:
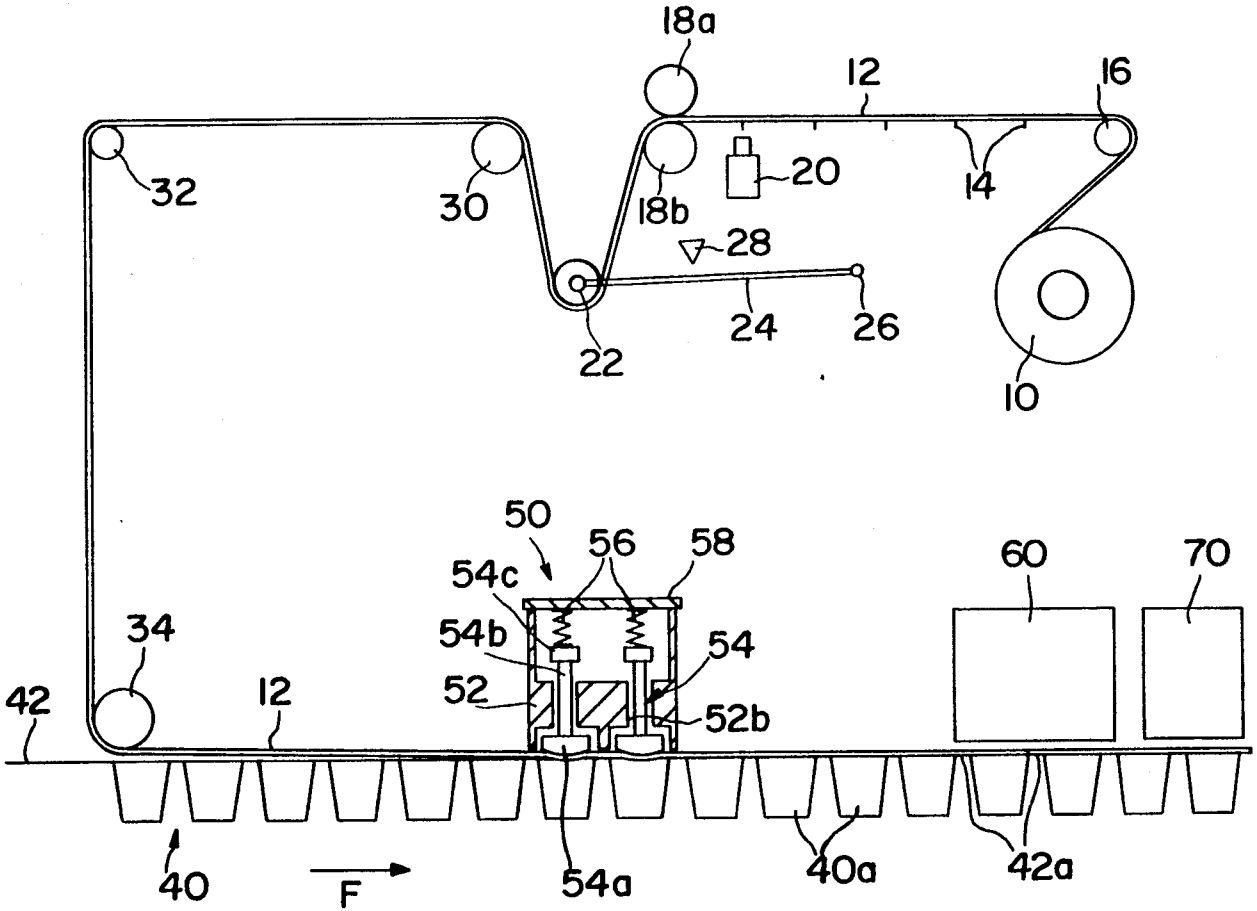
FIG. 1 is a diagrammatic vertical section view through apparatus of the invention for placing and fixing a strip of tops.
Figure 2:
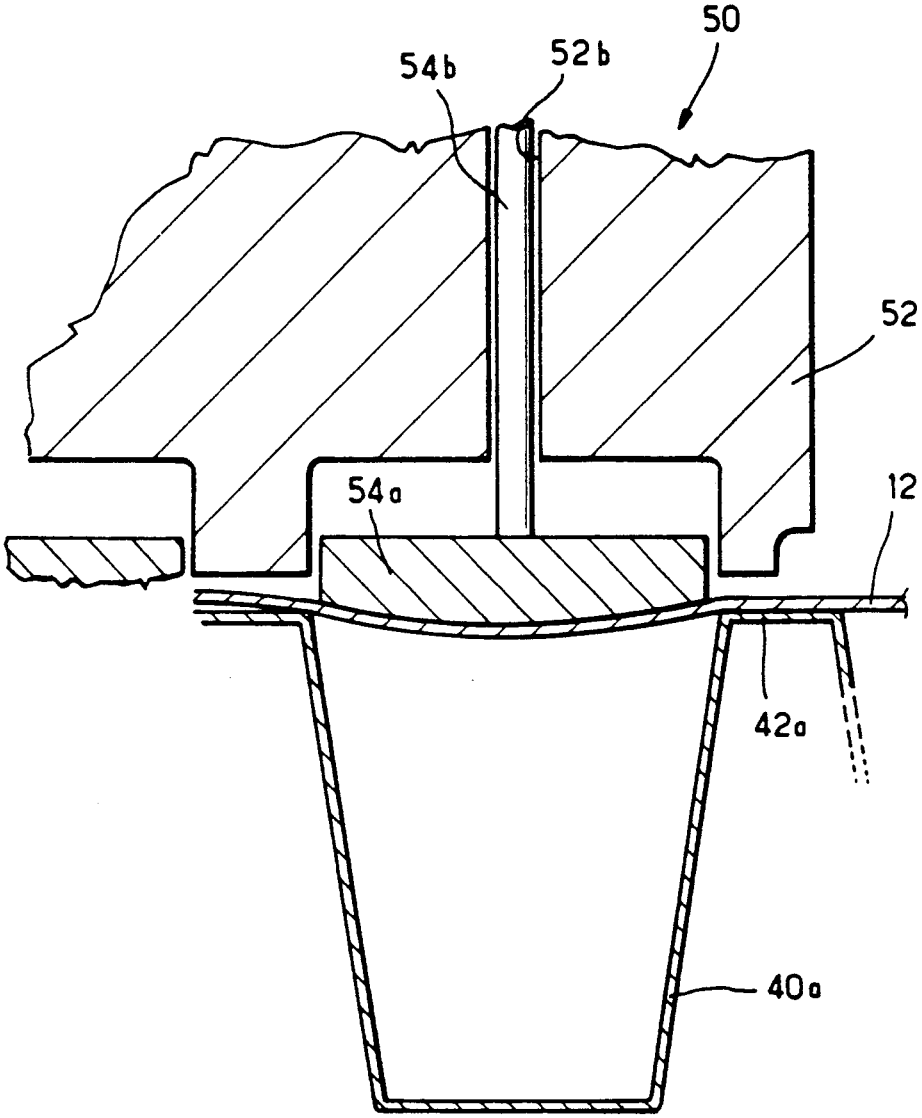
FIG. 2 is a vertical section view on a larger scale showing a detail of FIG. 1.

The strip 12 also includes optical markers or spots of a special color or a special coefficient of light absorption or reflection marked on the strip at a pitch identical to the longitudinal pitch of the patterns for the tops, and formed in conventional manner during printing. The spots 14 are indicated by vertical marks in FIG. 1, but it will be understood that in practice they lie in the plane of the strip 12.

The strip 12 which has its printing on its outside face while in the roll 10, passes over a first deflection cylinder 16 and then between two presser cylinders 18*a* and 18*b* driven in appropriate manner by a motor (not shown) to advance the strip in a manner that is controlled as described below. A photoelectric cell 20 is placed beneath the strip 12 between the cylinders 16 and 18*b* so as to read the reference spots 14 and deliver appropriate electrical signals to a control system (not shown).

On leaving the motor-driven cylinders 18*a* and 18*b*, the strip 12 passes round a jumping cylinder 22 mounted at the end of a rod or arm 24 whose other end is hinged at 26 about an axis that is parallel to the axis of the cylinder 22. An abutment 28 co-operates with the rod 24 to limit the upwards stroke of the cylinder 22. The assembly constituted by the components 22 to 28 constitutes a slack-takeup system whose function is explained in detail below.

Two deflection cylinders 30 and 32 are then provided to bring the strip successively into a horizontal position and then into a position where it extends essentially downwards towards the receptacles.

Reference 40 designates a continuous set of receptacles 40*a* that have previously been filled in a filling position (not shown). As can be seen, the receptacles 40*a* are in one piece at this stage, since they are being interconnected via their flanges 42*a* that lie in a common top plane 42 of the receptacles. A receptacle drive mechanism 70 (conventional) serves to displace said receptacles in the direction of arrow F at an appropriate step size and rate.

A deflection cylinder 34 is placed immediately above the plane 42 so that the strip of tops extends parallel to and above said plane, as shown.

The set of receptacles in association with its same-width strip of tops moves stepwise in the direction of arrow F firstly towards a welding position given an overall reference 50. This position essentially comprises a hot tool 52 which has a working bottom surface 52*a* shaped to correspond approximately to the still coupled-together flanges 42*a* of the receptacles. Thus, in conventional manner, each top 12*a* in the strip 12 is welded around its periphery to the associated flange 42*a*, thereby hermetically sealing the receptacle and closing it with a peel-off top.

As can be seen, the welding tool operates in this case on two transverse rows of receptacles simultaneously, however this characteristic is not limiting in any way.

According to an essential aspect of the invention, the hot tool 52 contains two rows of pushers 54 associated respectively with the two transverse rows of receptacles, with the pushers 54 being positioned so as to be at least approximately centered over respective receptacles.

Each pusher 54 comprises a head 54*a* which, as shown, defines a slightly bulging bottom surface for the pusher, together with a rod 54*b* extending upwards from the head through a guide bore 52*b* formed through the hot tool 52 to enable the pusher to slide vertically. The top of each rod 54*b* is provided with a part 54*c* constituting a seat for the bottom end of a compression spring 56 which is disposed vertically and which has its top end bearing against a top wall 58 of the tool 50. It may be observed that the seat 54*c* of each pusher may co-operate with the top surface of the hot tool 52 to limit the downward stroke of the pusher, essentially for the purpose of ensuring that the pushers do not fall out from the tool when the welding tool is raised to a distance above the receptacles.

On leaving the position 50, the set of receptacles with the strip of tops welded thereto is conveyed to a cutting-up position 60 constituted by a conventional type of press that is not described in detail and that serves to separate the receptacles either into individual receptacles or into groups of appropriate numbers of receptacles.

The above-described apparatus operates as follows.

Assume that the operation of welding two transverse rows has just been performed.

The welding tool 52 is then raised vertically together with its pushers 54 to allow the receptacles to be advanced.

The following actions are then performed synchronously: firstly the set of receptacles is advanced in the direction of arrow F through a distance corresponding exactly to the width of two transverse rows of receptacles; and secondly the film of tops 12 is advanced through a distance that is exactly equal to twice the distance between two successive marker spots 14. Thereafter, the mechanism for advancing the receptacles and the mechanism for advancing the film (i.e. the cylinders 18*a* and 18*b*) are both locked securely.

It should be noted at this point that in accordance with another important characteristic of the invention, the longitudinal pitch of the tops 12*a* in the film (the distance between two successive spots 14) is slightly greater than the longitudinal pitch of the receptacles 40*a*.

The effect of the two advance operations (receptacles and film) is to bring the following two rows of receptacles and the corresponding portion of the film beneath the welding position 50. Because of the above-mentioned pitch difference, it is possible to absorb any possible temporary offsets that may have occurred in the longitudinal direction between the receptacles and the strip 12 by taking appropriate action with the jumper roller 22, and it will be understood that these movements can be performed without requiring the receptacles to apply a large traction force to said strip, i.e. without applying troublesome forces to the advance mechanisms.

It will also be understood that after the above advance movement has come to an end, the individual tops 12*a* are properly aligned with the receptacles in the welding position, but that they are offset to the left in the figure by an amount equal to twice the difference between the longitudinal pitch of the tops and the longitudinal pitch of the receptacles (assuming that transverse rows are being processed in pairs).

The welding tool 50 is then lowered. The bottom surfaces of the heads 54*a* of the pushers then apply measured force to the center regions of the corresponding tops under thrust from the corresponding compression springs 56. By deforming said center regions downwards, this has the effect of exerting a small amount of traction on the strip 12 with the amplitude of the traction being controlled by the jumper. More precisely, the pushers 54 push down the center zones of the tops by deforming them until the rod 24 of the jumper comes into abutment against the associated abutment 28, whereupon the downward stroke of the pushers is stopped (the springs 56 are naturally calibrated to apply a small force so that the strip is subjected to substantially no lengthening).

Given that the strip of tops is not connected to the set of receptacles upstream from the welding position 50, it may be observed that the deformation imparted by the pushers to the strip begins by imparting practically no tension to the strip, but merely causes a small excess amount of strip material to be taken from the free side in addition to the length that is actually entrained by the receptacles during their initial movement, thereby absorbing on each occasion the difference that exists between the pitch of the receptacles and the greater pitch of the tops.

It will also be understood that by adjusting the position of the abutment 28 appropriately, it is possible to ensure that the action of the pushers 54 is to shift the edges of the patterns for individual tops 12*a* that are to the left in the figures towards the right so that these edges exactly overlie the lines along which the receptacles will be cut apart by the tool 60.

After the pushers have completed their action as set by the clearance of the abutment 28, the tool 52 performs the peripheral welding per se and the steps described above are repeated with the following two transverse rows of receptacles.

Typically, the pitch of the tops 12*a* in the strip 12 may be greater than the pitch of the receptacles by about 0.10 mm to 0.15 mm. In any event, this excess length is chosen so as to ensure that it is always longer than the inaccuracies that may appear in the patterns for the tops either on printing, or within the roll 10 (differences of temperature, humidity, compression, . . . ), with these inaccuracies being typically ±0.05 mm.

For example, if there should be a slight reduction in the distance between spots 14 at some point in the strip, which distance alone defines the distance through which the strip is advanced by the cylinders 18*a* and 18*b*, then, during the above-described synchronized advance of the receptacles and the strip, the jumper cylinder 22 will not move down quite so far, and thus the gap between the rod 24 and its abutment 28 before the pushers 54 come into action will be smaller. Consequently, the action of the pushers 54 prior to welding will be smaller in amplitude, thereby taking account of the temporary reduction in the difference between the pitch of the tops and the pitch of the receptacles.

The means described thus make it possible to perform regulation simply and effectively to compensate for any inaccuracy in the patterns of the tops.

Naturally the present invention is not limited to the particular embodiment described above and shown in the drawings, and the person skilled in the art will be able to make any variant or modification thereto that comes within the scope of the invention.

For example, if the pushers 54 are heavy, then the associated springs 56 may be omitted, with the central zones of the tops being deformed solely by the force of gravity acting on the pushers.

I claim:

1. A method for registering in a sealing station prior to sealing, at least one receptacle of a continuous web of successive interconnected receptacles with at least one corresponding top of a continuous strip of successive tops overlying said receptacle in said sealing station, said method comprising the steps of:

a) longitudinally advancing the continuous web of receptacles step by step through said sealing station so that the length of one step is equal to a selected one of a unitary longitudinal distance between a downstream and an upstream border of said receptacle, or a multiple of said unitary distance, and according to which the strip of tops bears on each top an optical marker longitudinally separated from the optical marker of the immediately adjacent top of the strip by a space slightly greater than the unitary longitudinal distance of the upstream and downstream borders of a receptacle of the receptacle web;

b) sealing at least one top to a flange or rim portion of at least one corresponding receptacle in a registered position inside the said sealing station;

c) advancing together the web of receptacles and the strip of tops through a distance equal to one longitudinal step of said web so that the receptacle sealed with a top is positioned past said sealing station and an unsealed receptacle and a corresponding top of the strip of tops are introduced into said sealing station;

d) simultaneously unwinding a portion of the top strip, said portion having a length slightly greater than one longitudinal web step and equal to the distance between two successive optical markers or to a multiple of said distance while a previously unwound portion of said strip is advanced together with said web of receptacles one longitudinal web step;

e) creating a deformation in the center part of each top overlying a receptacle with said flange or rim portion located inside the sealing station, so as to advance the top strip by a length equal to the difference between the space separating two optical markers or a multiple thereof and the length of one receptacle web step, and to register exactly at least one top overlying at least one receptacle inside said sealing station; and f) repeating steps b) through e) until each of said receptacles on said web is sealed.

2. A method according to claim 1, in which the spaces between successive optical markers on the strip of tops present a predetermined absolute variation in length, wherein the difference between the longitudinal space separating two markers of the tops and the longitudinal step of the web of receptacles is slightly greater than a maximum positive value of said variation in length.

3. A method according to claim 1, wherein the operation of deformation of the top overlying a receptacle in the sealing station is performed by applying downwards pressure onto the center part of the top towards the inside volume of the underlying receptacle and without any elongation of the strip of tops.

4. A method according to claim 3, wherein the magnitude of the deformation of the top and the amplitude of the corresponding longitudinal shift of the strip of tops is limited to the difference between the space separating two successive markers or a multiple of said space and the length of one step of the receptacle web.

5. Apparatus for registering in a sealing station prior to sealing, at least one receptacle of a continuous web of receptacles with at least one corresponding top of a continuous strip of tops overlying said receptacle in said sealing station, each top of the strip bearing an optical marker longitudinally separated from the marker of the following top by a space of predetermined length, wherein the apparatus comprises:

a receptacle web-advance mechanism for longitudinally advancing step by step a web of receptables towards and through a sealing station so that the length of one step is equal to the longitudinal distance between a downstream and an upstream border of said receptacle or to a multiple of said distance;

a roll of a strip of tops;

a strip-unwinding mechanism for unwinding from said roll a portion of the strip of tops upstream of said sealing station, said portion having a length equal to one space separating the markers of two successive tops or to a multiple thereof, said strip being sealed to the receptacle web along flange or rim portions of the receptacles in said sealing station and advanced together with the receptacle web, and said unwound portion of the top strip having a length slightly greater than the longitudinal step of the receptacle web;

said sealing station including a deformation means for deforming the central zones of the tops overlying the receptacles within said flange or rim portions in the sealing station, thereby shifting the top strip upstream of the sealing station downstream toward the sealing station; and regulation means for regulating the amplitude of the top deformation so as to shift the edges of unsealed tops to a position where they overlie and register with the corresponding edges of the receptacles located in said sealing station.

6. Apparatus according to claim 5, wherein the deformation means comprise a set of vertically movable pushers slidably received in a sealing tool.

7. Apparatus according to claim 6, wherein the pushers are urged downwards by resilient means.

8. Apparatus according to claim 6, wherein each pusher includes a head with a convex bottom surface.

9. Apparatus according to claim 5, wherein the regulation means comprises a dancer roll associated with a stop and applied onto the strip downstream from the strip-unwinding mechanism.

10. Apparatus according to claim 5, wherein the strip-unwinding mechanism comprises motor-driven cylinders controlled as a function of signals received by a sensor for sensing the markers provided on the strip of tops.

* * * * *

UNITED STATES PATENT AND TRADEMARK OFFICE

CERTIFICATE OF CORRECTION

PATENT NO. : 5,230,205

DATED : July 27, 1993

INVENTOR(S) : Hautemont

It is certified that error appears in the above-indentified patent and that said Letters Patent is hereby corrected as shown below:

Column 2, line 50, change "selaing" to --sealing --.

Signed and Sealed this

Eighteenth Day of July, 1995

Bruce Lehman

*Attest:*

BRUCE LEHMAN

*Attesting Officer*

*Commissioner of Patents and Trademarks*